United States Patent [19]

Roberts et al.

[11] Patent Number: 4,806,112

[45] Date of Patent: Feb. 21, 1989

[54] SAFETY ADAPTER FOR ELECTRICAL CONNECTOR HOUSINGS

[75] Inventors: Richard R. Roberts, Dana Point; Robert J. Frank, Tustin; Philip H. Booker, III, El Toro; Rodney A. Hemner, Costa Mesa, all of Calif.

[73] Assignee: Tronomed, Inc., San Juan Capistrano, Calif.

[21] Appl. No.: 103,503

[22] Filed: Oct. 1, 1987

[51] Int. Cl.[4] ..... H01R 13/44

[52] U.S. Cl. ..... 439/144; 439/147; 439/148; 439/149; 439/135

[58] Field of Search ..... 439/135, 136, 142, 144, 439/147, 149, 596, 133, 134

[56] References Cited

U.S. PATENT DOCUMENTS

| | | | |
|---|---|---|---|
| 2,545,762 | 3/1951 | Brown | 339/36 |
| 2,851,668 | 9/1958 | Kobler et al. | 439/149 |
| 3,389,367 | 6/1968 | Schwartz | 439/148 |
| 3,631,320 | 12/1971 | Eckert | 439/135 |
| 3,711,813 | 1/1973 | Bryant | 439/144 |
| 4,060,297 | 11/1977 | Marshall et al. | 339/37 |
| 4,204,723 | 5/1980 | Bloomingdale | 339/36 |
| 4,438,995 | 3/1984 | Fisher et al. | 439/147 |

*Primary Examiner*—Gil Weidenfeld
*Assistant Examiner*—Paula A. Austin
*Attorney, Agent, or Firm*—Price, Gess & Ubell

[57] ABSTRACT

A safety adaptor for a male electrical connector housing having at least one male terminal is provided. A body member having a space therein of a configuration to receive the electrical connector housing while operatively supporting a cantilevering of the male terminal from the body member is utilized. A cover member can be flexibly linked to the body member for locking the safety adaptor to the electrical connector housing. A pair of parallel prongs can extend from the body member and can be positioned for limiting the size of a complementary female connector capable of operatively receiving the male terminal member.

17 Claims, 1 Drawing Sheet

SAFETY ADAPTER FOR ELECTRICAL CONNECTOR HOUSINGS

BACKGROUND OF THE INVENTION

1. Field of the Invention

The present invention relates to electrical connector and lead wire cable assemblies, and more particularly, to an improved safety adaptor for attachment to a conventional male electrical connector housing.

2. Description of Related Art

In order to determine the electrical phenomena arising from physiological functioning of a patient, such as apnea monitoring of an infant or an electrocardiographic monitoring of a patient, it is necessary to electrically interconnect the patient with transducers or electrodes contacting the skin of a patient with a monitoring instrument, such as an electrocardiographic device. Numerous different arrangements of interconnecting cable and connector assemblies have been known in the prior art such as disclosed in U.S. Pat. No. 4,632,121. This patent recognizes possible problems that can occur when a terminal pin is mounted in the wrong terminal bore and attempts to provide a configuration to insure proper mating of cable sets. Various suggestions have been made to modify a conventional lead wire connector housing with a molded pair of prongs extending adjacent and parallel to a male electrode terminal. The prongs are dimensioned to be sufficiently spaced apart to permit the male terminal pin to be connected in a female bore, for example, on a patient cable. The female connector housing of the patient cable must have a thickness less than the distance between the prong members. While this proposal addresses the safety problem for new instrumentation and new cable sets, it does not address the existing problem in conventional patient cables and lead wire connectors that are presently in use. Various examples of protective devices for male electrical plugs can be seen in U.S. Pat. No. 4,060,297, U.S. Pat. No. 2,545,762, and U.S. Pat. No. 4,204,723.

The safety problems of using these conventional lead wires will continue to exist until the lead wires themselves are replaced. Thus, the problem remains in the prior art in improving the safety of conventional lead wires and patient cable assemblies.

SUMMARY OF THE INVENTION

The present invention provides a safety adaptor for attachment to conventional male electrical connector housings having one or more male terminals. The adaptor body member is provided with a space or cavity therein of a configuration to receive and maintain the electrical connector housing while operatively supporting a cantilevering of a male terminal or terminals from the body member. The body member can have a bow-like or reduced width exterior configuration with friction rib members on the exterior sides of the housing. The configuration of the space within the body member can be a central groove with an entrance and exit flange of a dimension to permit a friction mounting of the electrical connector housing. Extending from one end of the body member are a pair of rectangular prong members that are spaced in a parallel alignment on opposite sides of the male terminal member. As can be appreciated, various configurations of the prong members can be successfully utilized. A cover member having an interior central flute can be connected by a plastic living hinge to the body member. The cover member can have a series of staking posts on its interior face that are aligned for corresponding insertion into a plurality of faceted apertures positioned on the sides of the body member for frictionally retaining the staking posts and locking the cover member to the body member. Thus, a standard electrical connector housing can have an added safety feature to prevent an improper insertion of the male terminal or terminals into an undesirable female connector terminal bore.

Further objects and advantages of this invention will become apparent from a review of the following specification, claims and the attached drawings.

DESCRIPTION OF THE PREFERRED EMBODIMENTS

The following description is provided to enable any person skilled in the art of medical cable assemblies and electrode connector units to make and use the invention, and it sets forth the best modes contemplated by the inventors for carrying out their invention. Various modifications, however, will remain readily apparent to those skilled in the above art, since the generic principles of the present invention are applied herein specifically to provide a relatively economical and easily manufacturable safety adaptor for a male electrical connector housing.

While the present invention can have broad application as an accessory safety adaptor for conventional male electrical connector housings in different industries, it is of particular interest for medical use and the preferred embodiment disclosed herein is directed to connector housings and terminal in the medical field.

Figure 1:
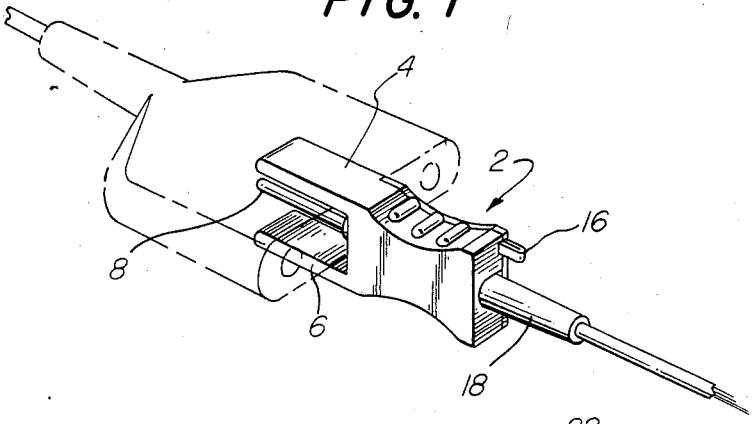
FIG. 1 is a perspective view of a safety adaptor of the present invention mounted on a male electrical connector for attachment to a female patient cable.

Referring to FIG. 1, a perspective view of a male electrical connector housing having a single electrode terminal with a safety adaptor 2 of the present invention is shown. The phantom lines in FIG. 1 indicate a compatible female patient cable. As can be seen, the distance between a pair of rectangular configured prong members 4 and 6 are of sufficient dimension to extend across either side of the patient cable. The male electrical terminal 8 is uninhibited in providing the desired electrical connection with the female bore in the patient cable. In the preferred embodiment, the safety adaptor 2 is a molded, one-piece member from a plastic such as a thermal plastic, polypropylene. Preferably, the plastic is transparent to enable visibility of any color-coded molded ends of lead wires to permit proper mating of a patient end of the connector cable.

Figure 2:
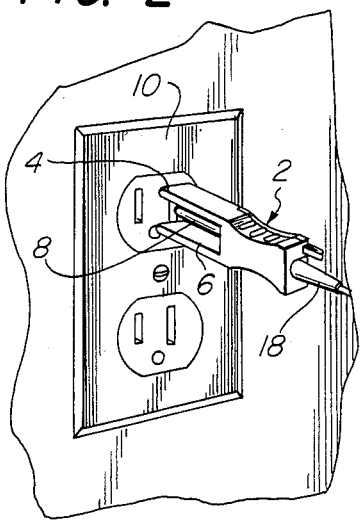
FIG. 2 is a perspective view of the conventional male electrical connector with the safety adaptor and a common electrical outlet to disclose the safety features of prohibiting the improper insertion of a male terminal member.

Referring to FIG. 2, a perspective view of the safety adaptor 2 is disclosed as it protects against the improper insertion of the male terminal 8 into an undesirable female connector 10 such as a common electrical outlet in a house. The example of an electrical outlet in a house would be appropriate in the environment of, for example, an apnea monitor for an infant with a male terminal electrical connector housing being part of a lead wire to the transducer attached to the infant. Thus, if there are other small children in the house, the parents can feel more comfortable that a tragic accident can be avoided through the use of the present safety adaptor on the conventional electrical connector housing of the lead wire.

Figure 3:
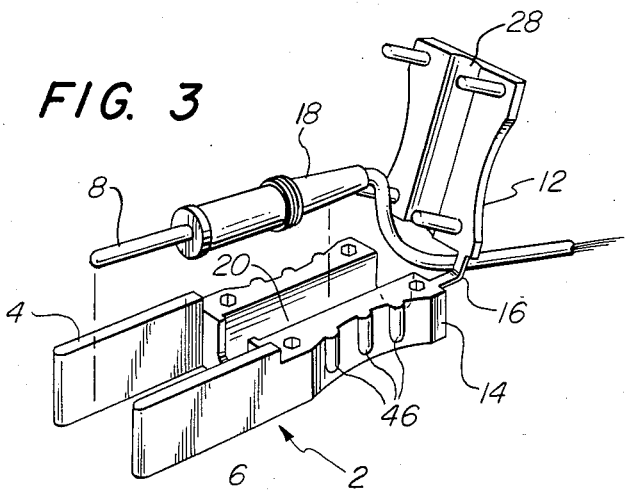
FIG. 3 is a perspective view of the safety adaptor in an open configuration.

FIG. 3 discloses a perspective view of the safety adaptor 2 with the cover member 12 in an open position. The cover member 12 is connected to the body member 14 of the safety adaptor 2 by a flexible link 16 that is more conventionally known in the plastic molding art as a living hinge. The living hinge is constructed by a flexing of the flexible link with a reduced thickness on a part of the flexible link. By this particular design, the cover member 12 can be conveniently retained with the body member 14 to facilitate its application to an electrical connector housing, such as the patient terminal lead 18, shown in FIG. 3. The link 16 is provided at the rear edge of the body member 14 to insure a smooth surface on both side edges of the body member 14 thereby eliminating any rough edges and removing any collection sites for dirt.

Figure 5:
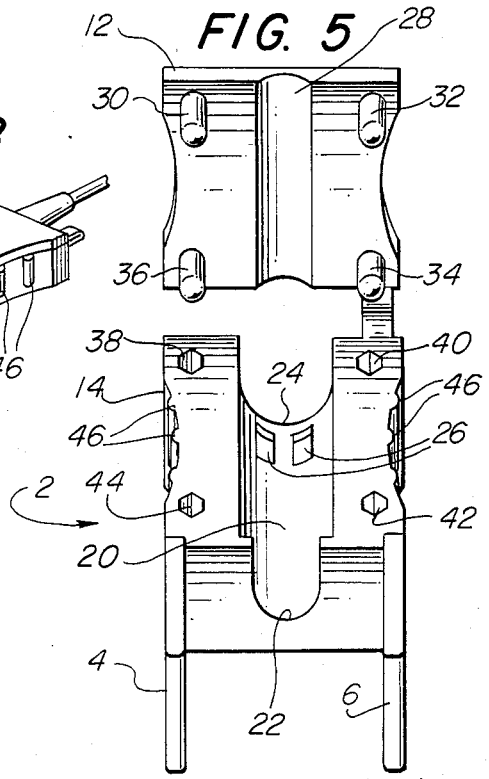
FIG. 5 is a perspective front view of the adaptor with the cover member open.

The body member 14 has a central groove 20, a forward flange 22, and a rear flange 24 in FIG. 5. A pair of indexing shoulders 26 are positioned within the central groove 20. The indexing shoulders are of a configuration complementary with the exterior envelope of the electrical connector housing 18. The cover member 12 has a central flute 28 also complementary with the exterior envelope of the connector housing 18 and a set of staking posts 30, 32, 34 and 36. The staking posts are designed to interface frictionally with a corresponding plurality of faceted apertures in the body member 14 shown respectively as apertures 38, 40, 42 and 44. The staking posts can have a tubular configuration and the apertures can have a side wall faceted configuration such as a hexagon to insure a locking frictional fit that will permanently retain a cover member 12 to the body member 14 after the cover member 12 is inserted into a closed position. Since the safety adaptor of the present invention is specifically designed for retro fitting of conventional cable sets by non-technical personnel, there are no requirements of special tools, applicators or adhesives required in the assembling.

While the exterior of the body member 14 can take various configurations, the preferred embodiment utilizes a relatively thin bow-like configuration that is particularly adaptable to a two-finger grip by the operator for the insertion of the male terminal into a female connector housing. To further facilitate the grip of the operator, a series of rib members 46 can be molded on the concave side portions of the body member 14.

Figure 4:
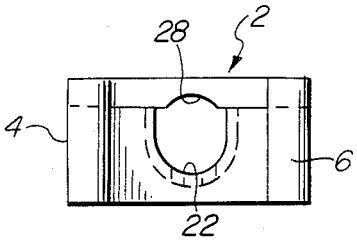
FIG. 4 is a front-end view of the safety adaptor.
Figure 6:
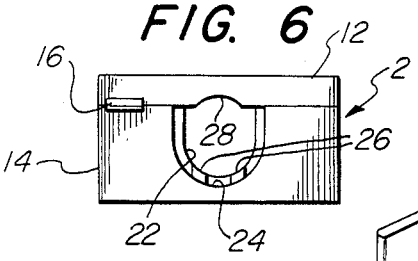
FIG. 6 is a rear-end view of the safety adaptor.
Figure 7:
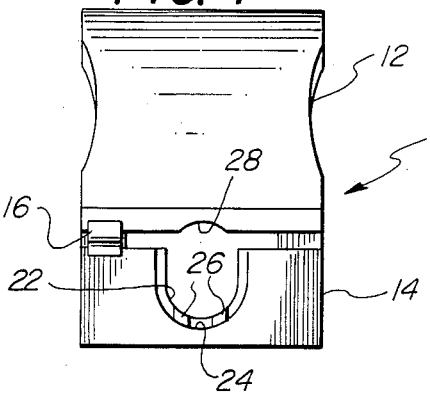
FIG. 7 is a perspective rear view with the cover member open.

The correlation of the central flute 28 on the cover member 12 with the forward and rear flanges 22 and 24 can be seen in the front and rear elevational views of FIGS. 4 and 6. FIGS. 5 and 7 provide open rear and front perspective views of the safety adaptor 2 of the present invention.

Figure 8:
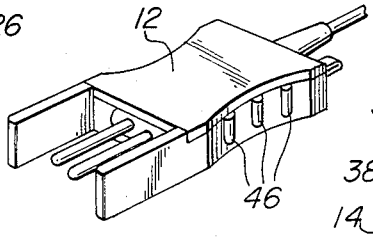
FIG. 8 is a perspective view of an alternative embodiment of a safety adaptor for a twin-pin connector housing.

Finally, referring to FIG. 8, an alternative embodiment of the safety adaptor is shown in a configuration suitable for mounting on a male electrical connector housing having 2 terminals. As can be appreciated, a number of pin terminals can be utilized within the scope of the present invention. While the preferred embodiment of the present invention discloses a pivotally mounted cover member, it can be appreciated that other configurations can be utilized. Additionally, the fastening of the cover member to the body member can be accomplished by other devices.

While the above embodiments have been disclosed as the best modes presently contemplated by the inventors, it should be realized that these examples should not be interpreted as limiting because artisans, skilled in this medical field, once given the present teaching, can vary from the specific embodiments.

Accordingly, the scope of the present invention determines solely from the following claims.

What is claimed is:

1. A safety adaptor for a male electrical connector housing have at least one male terminal comprising:

a body member having a central groove with forward and rear flanges therein of a configuration to receive a the electrical connector housing while operatively supporting a cantilevering of the male terminal from the body member;

means, extending from the body member and positioned adjacent the male terminal, for limiting the size of a complementary female connector capable of operatively receiving the male terminal member; and means for fastening the body member about the male electrical connector housing whereby a standard electrical connector housing has an added safety feature to prevent an improper insertion of the male terminal into an undesirable female connector, wherein the means for fastening includes a cover member pivotally attached to the body member.

2. The safety adaptor of claim 1 wherein the body member has a bow-like exterior configuration.

3. The safety adaptor of claim 2 wherein the means for fastening includes the cover member pivotally attached to the body member.

4. The safety adaptor of claim 2 wherein the sides of the exterior configuration include a plurality of rib members.

5. The safety adaptor of claim 2 wherein the means for fastening includes a living hinge plastic member interconnecting the cover member and the body member.

6. The safety adaptor of claim 2 wherein the cover member has a central flute.

7. The safety adaptor of claim 2 wherein the cover member has a plurality of staking posts and the body member has a corresponding plurality of faceted apertures for frictionally retaining the staking posts.

8. The safety adaptor of claim 2 wherein the mean for limiting includes a pair of prong members.

9. The safety adaptor of claim 8 wherein the prong members are a pair of rectangular configured members in parallel alignment.

10. A safety adaptor for retrofitting a male electrical connector housing having at least one male terminal comprising:

a body member having a space therein of a configuration to receive the electrical connector housing while operatively supporting a cantilevering of the male terminal from the body member including a front and a rear mounting flange;

means, extending from the body member and positioned adjacent the male terminal, for limiting the size of a complementary female connector capable of operatively receiving the male terminal member; and means for permanently fastening the body member about the male electrical connector housing whereby a standard electrical connector housing has an added safety feature to prevent an improper insertion of the male terminal into an undesirable female connector.

11. The safety adaptor of claim 10 wherein the means for limiting includes a pair of prong members.

12. The safety adaptor of claim 10 wherein the body member has a central groove with the front and rear flange positioned at either end of the groove.

13. The safety adaptor of claim 12 wherein a pair of indexing shoulders are positioned in the central groove.

14. The safety adaptor of claim 10 wherein the means for fastening includes a cover member pivotally attached to the body member.

15. The safety adaptor of claim 14 wherein the means for fastening includes a living hinge plastic member interconnecting the cover member and the body member.

16. The safety adaptor of claim 14 wherein the cover member has a plurality of staking posts and the body member has a corresponding plurality of faceted apertures for frictionally retaining the staking posts.

17. The safety adaptor of claim 16 wherein the body member has a central groove with front and rear flanges positioned at either end of the groove.

* * * * *